US011527370B2

(12) United States Patent
Huang

(10) Patent No.: US 11,527,370 B2
(45) Date of Patent: Dec. 13, 2022

(54) DOME SWITCH BUTTON

(71) Applicant: Primax Electronics Ltd., Taipei (TW)

(72) Inventor: Tai-Sou Huang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/336,039

(22) Filed: Jun. 1, 2021

(65) Prior Publication Data

US 2022/0351922 A1 Nov. 3, 2022

(30) Foreign Application Priority Data

Apr. 28, 2021 (TW) ..... 110115438

(51) Int. Cl.
*H01H 13/10* (2006.01)
*H01H 13/14* (2006.01)
*H01H 13/52* (2006.01)

(52) U.S. Cl.
CPC ..... *H01H 13/10* (2013.01); *H01H 13/14* (2013.01); *H01H 13/52* (2013.01); *H01H 2203/038* (2013.01)

(58) Field of Classification Search
CPC ..... H01H 13/10; H01H 13/14; H01H 13/52
USPC ..... 200/512
See application file for complete search history.

(56) References Cited

U.S. PATENT DOCUMENTS 10,373,775 B2 * 8/2019 Ito ..... H01H 13/52
10,488,954 B1 * 11/2019 Huang ..... G06F 1/169
2020/0203100 A1 * 6/2020 Huang ..... G06F 3/03547

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A dome switch button is installed on a circuit board. The dome switch button includes an elastic piece, a conductive piece and a buffering element. The elastic piece is located over the conductive piece. The buffering element is located under the conductive piece and electrically connected with the circuit board. When the elastic piece is subjected to elastic deformation to trigger the conductive piece, an electric signal is generated. The buffering element is electrically connected with the circuit board. Moreover, a first electric pad and a second electric pad of the circuit board are covered by the buffering element. The electricity from the first electric pad and the second electric pad of the circuit board can be transferred to the conductive piece through the buffering element. Consequently, the conductive piece can be electrically connected with the circuit board without the need of using additional conductor lines.

7 Claims, 6 Drawing Sheets

DOME SWITCH BUTTON

FIELD OF THE INVENTION

The present invention relates to a button, and more particularly to a dome switch button.

BACKGROUND OF THE INVENTION

A dome switch button is a button that uses a dome-shaped elastic piece to trigger a circuit board to generate an electric signal. The dome-shaped elastic piece has elastic deformability. While the button is depressed, in response to the elastic deformability of the elastic piece, the raised dome center portion of the elastic piece is subjected to deformation in the direction toward the circuit board. When the raised dome center portion of the elastic piece is contacted with the circuit board, the portion of the circuit board corresponding to the elastic piece is electrically conducted to generate electricity. Consequently, the electric signal is generated. The structure of the conventional dome switch button will be described with reference to FIG. 1.

FIG. 1 is a schematic exploded view illustrating the relationship between a conventional dome switch button and a circuit board. As shown in FIG. 1, the conventional dome switch button 9 comprises a dome-shaped elastic piece 91 and a conductive piece 92. The conductive piece 92 comprises conductor lines 921. The surface of the circuit board 93 is equipped with electric pads 931. The dome switch button 9 is installed on the circuit board 93. In addition, the dome switch button 9 is electrically connected with the electric pads 931 of the circuit board 93 through the conductor lines 921. When the conductive piece 92 is triggered by the dome-shaped elastic piece 91 and electrically conducted to generate the electricity, the electricity flows to the electric pads 931 through the electric pads 931 and flows into the circuit board 93. Consequently, an electric signal is generated.

However, the conventional dome switch button 9 still has some drawbacks. For example, the conductive piece 92 of the conventional dome switch button 9 additionally comprises conductor lines 921, and the conductor lines 921 are extended from the conductive piece 92 to be electrically connected with the circuit board 93. In addition, it is necessary to change the lengths of the conductor lines 921 or adjust the extending directions of the conductor lines 921. That is, it is impossible to install the conductive piece 92 on the surface of the circuit board 93 in a simple and intuitive manner. Moreover, the conductor lines 921 extended from the conductive piece 92 increase the length and width of the button area. When the dome switch button 9 is installed on the circuit board 93, it is necessary to retain a spare space for the installation of the conductor lines 921. The retained spare space occupies a lot of space and also affects the circuit design on the circuit board.

SUMMARY OF THE INVENTION

For solving the drawbacks of the conventional technologies, the present invention provides a dome switch button. A conductive buffering element is located under a conducive piece of the dome switch button. The conductive piece is electrically connected with the electric pads of a circuit board through the buffering element. In other words, the conductive piece can be directly installed over the electric pads without the additional conductor lines. Since the conductive piece is simply installed on the circuit board, the space of the circuit board is not wasted. Moreover, the buffering element provides a buffering function and an anti-collision function to alleviate the compact force of the deformed dome-shaped elastic piece in the depressed state. Consequently, the tactile feel can be maintained, and the use life of the conductive piece can be protected.

In accordance with an aspect of the present invention, a dome switch button is provided. The dome switch button is installed on a circuit board. The dome switch button includes an elastic piece, a conductive piece and a buffering element. The elastic piece has a conductive surface. The conductive piece is located under the conductive surface of the elastic piece. The conductive piece includes a first conductive part and a second conductive part. The buffering element is located under the conductive piece and electrically connected with the first conductive part and the second conductive part of the conductive piece. The circuit board includes a first electric pad and a second electric pad. The first electric pad and the second electric pad of the circuit board are covered by the buffering element. The buffering element is electrically connected with the first electric pad and the second electric pad of the circuit board.

In an embodiment, the conductive surface of the elastic piece includes a peripheral part and a triggering part. The peripheral part is electrically connected with the first conductive part of the conductive piece. The triggering part is aligned with the second conductive part of the conductive piece.

In an embodiment, the conductive piece has a top surface and a bottom surface. The top surface of the conductive piece is aligned with the conductive surface of the elastic piece. The bottom surface of the conductive piece is aligned with the buffering element.

In an embodiment, the first conductive part of the conductive piece is extended from the top surface to the bottom surface, so that the first conductive part of the conductive piece is electrically connected with the conductive surface of the elastic piece and the buffering element. The second conductive part of the conductive piece is extended from the top surface to the bottom surface, so that the second conductive part of the conductive piece is aligned with the conductive surface of the elastic piece and electrically connected with the buffering element.

In an embodiment, the conductive piece further includes at least one first conductive hole and at least one second conductive hole. The at least one first conductive hole and the at least one second conductive hole are in communication with the top surface and the bottom surface of the conductive piece.

In an embodiment, the at least one first conductive hole is formed in the first conductive part of the conductive piece, so that the first conductive part is extended from the top surface to the bottom surface through the at least one first conductive hole. The at least one second conductive hole is formed in the second conductive part of the conductive piece, so that the second conductive part is extended from the top surface to the bottom surface through the at least one second conductive hole.

In an embodiment, the buffering element includes a first conducting region, a second conducting region and an insulation region. The insulation region is arranged between the first conducting region and the second conducting region, so that the first conducting region and the second conducting region are not contacted with each other.

In an embodiment, the first conducting region of the buffering element is electrically connected with the first conductive part of the conductive piece and the first electric pad of the circuit board, and the second conducting region of the buffering element is electrically connected with the second conductive part of the conductive piece and the second electric pad of the circuit board.

In an embodiment, the first electric pad of the circuit board is covered by the first conducting region of the buffering element, and the second electric pad of the circuit board is covered by the second conducting region of the buffering element.

From the above descriptions, the present invention provides a dome switch button. The dome switch button can be directly installed on the electric pads of the circuit board and electrically connected with the electric pads. In other words, the additional conductor lines are not required. Consequently, the layout space of the circuit board is saved, the volume of the dome switch button is reduced, and the assembling process is simplified. Moreover, the use of the buffering element can alleviate the compact force of the deformed dome-shaped elastic piece in the depressed state. Consequently, the tactile feel can be maintained, and structure of the dome switch button can be protected.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
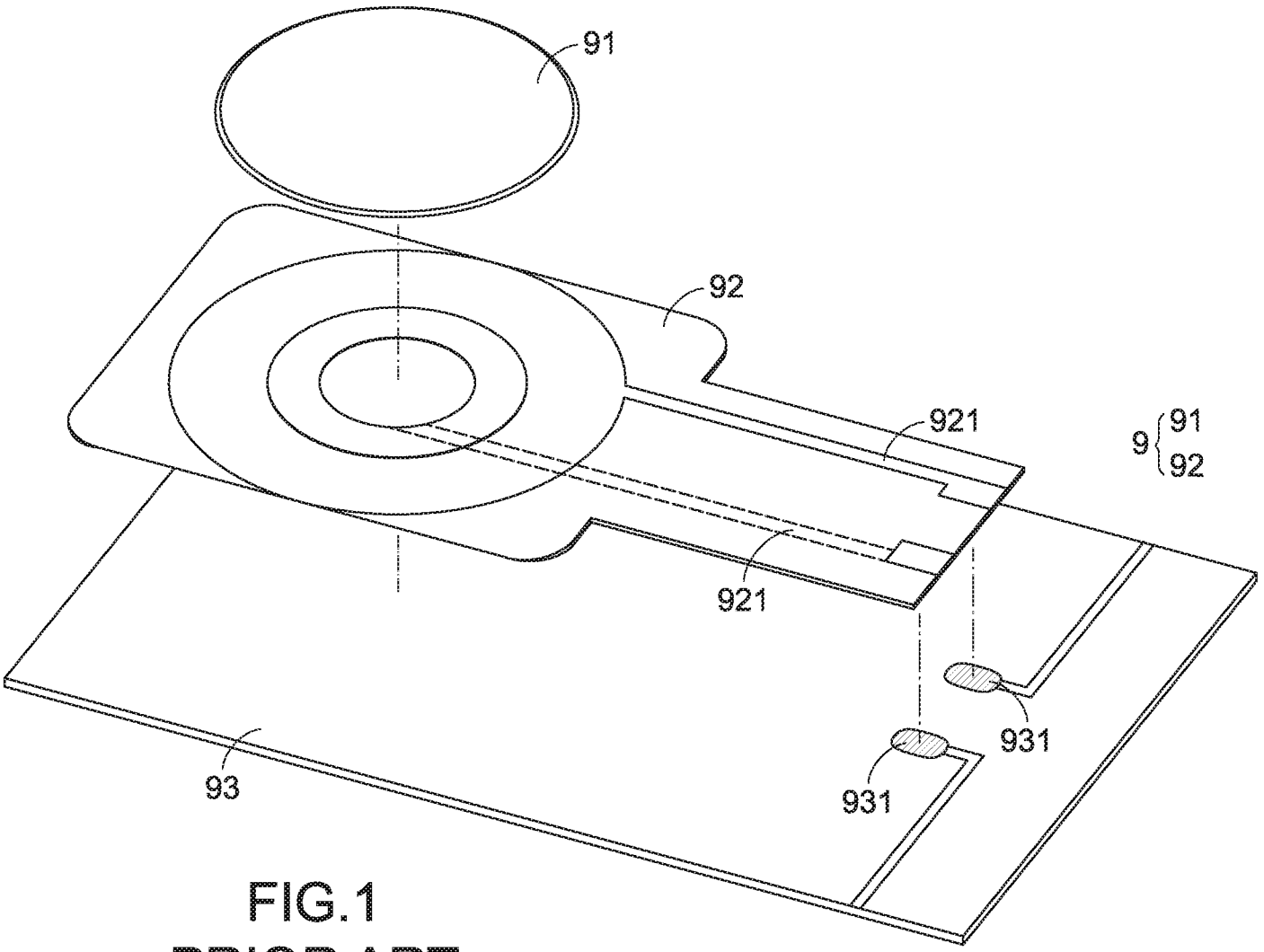
FIG.1 PRIOR ART
FIG. 1 is a schematic exploded view illustrating the relationship between a conventional dome switch button and a circuit board.
Figure 2:
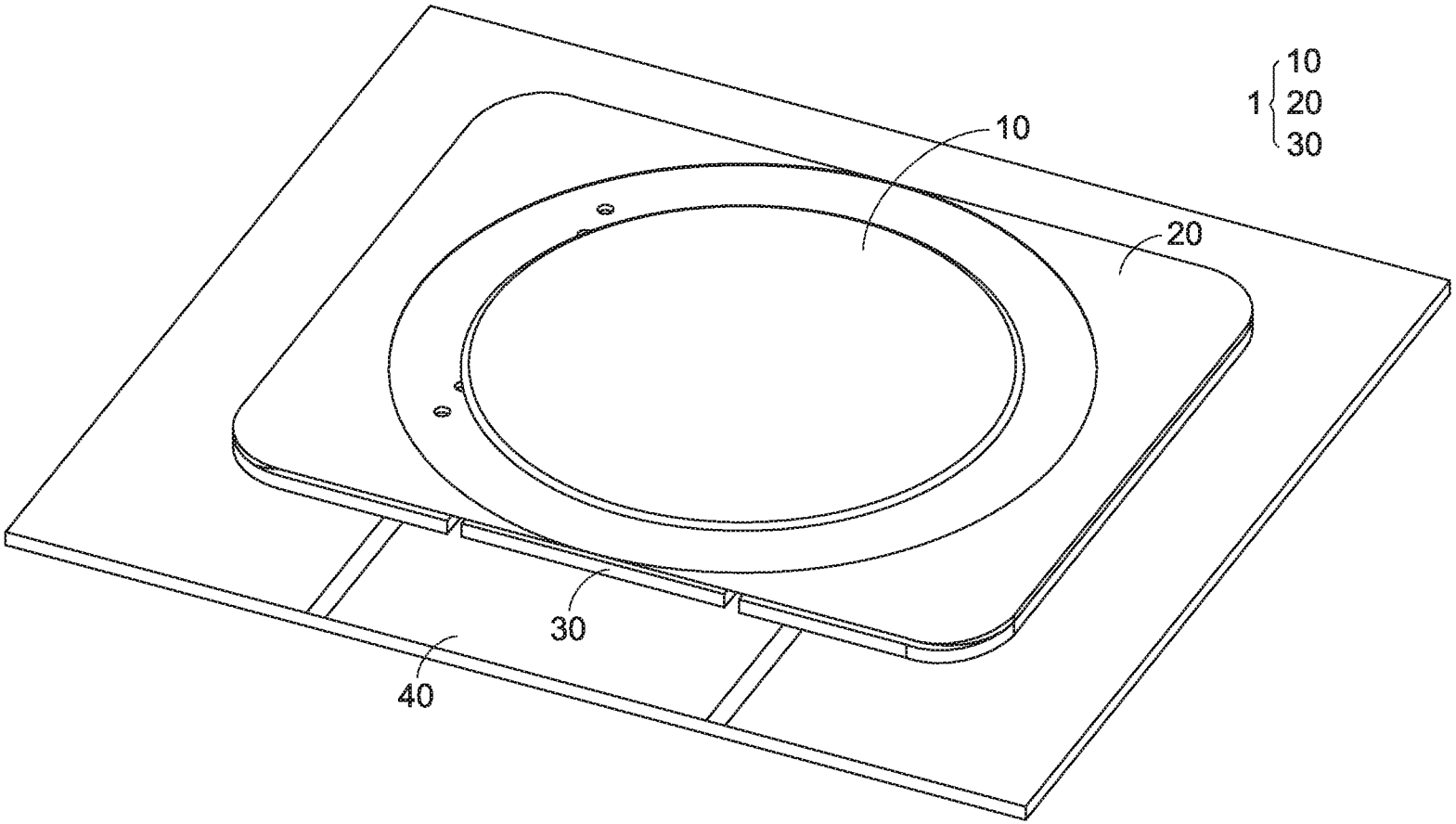
FIG. 2 is a schematic perspective view illustrating the relationship between a dome switch button and a circuit board according to an embodiment of the present invention.
Figure 3:
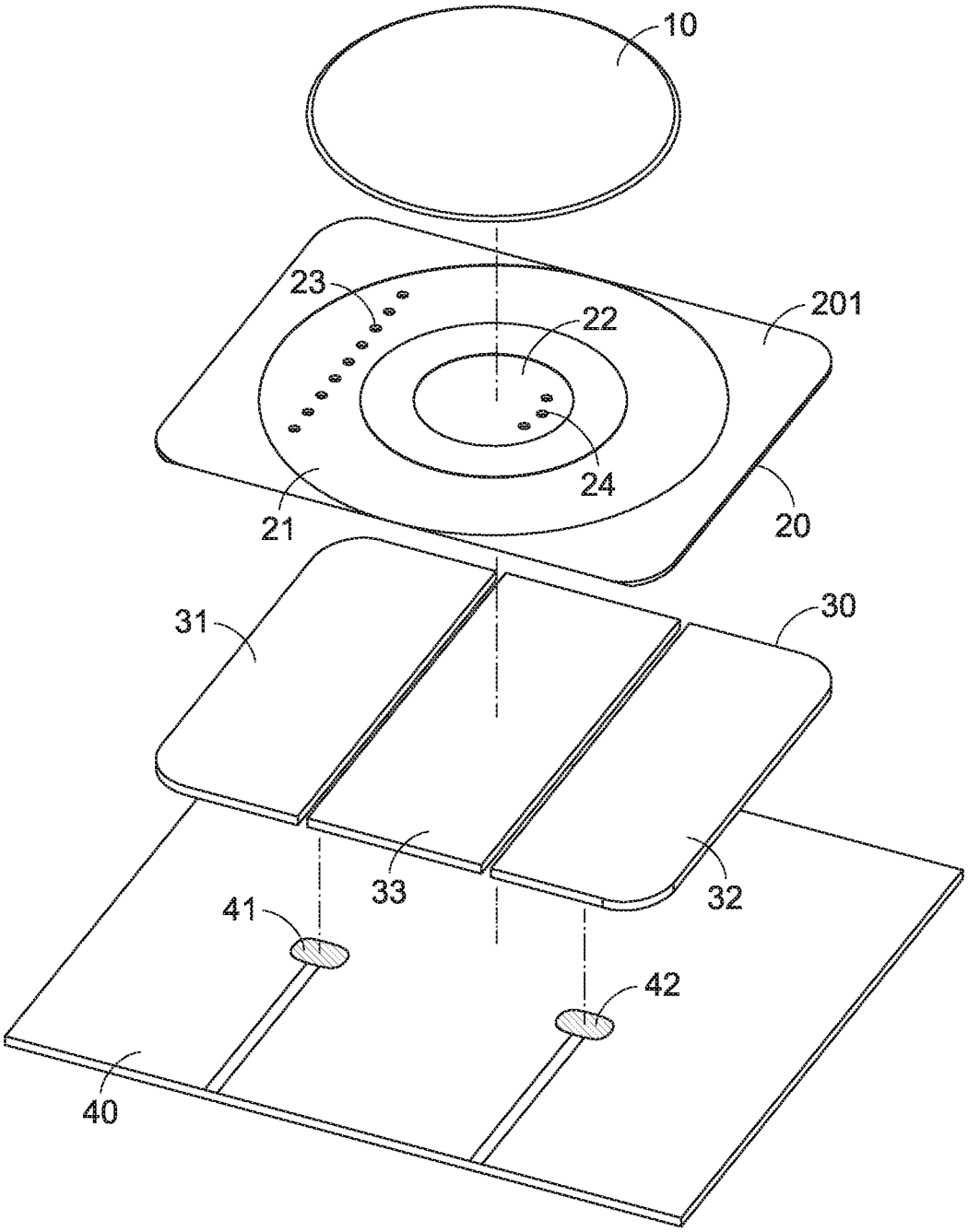
FIG. 3 is a schematic exploded view illustrating the relationship between the dome switch button and the circuit board as shown in FIG. 2.
Figure 4:
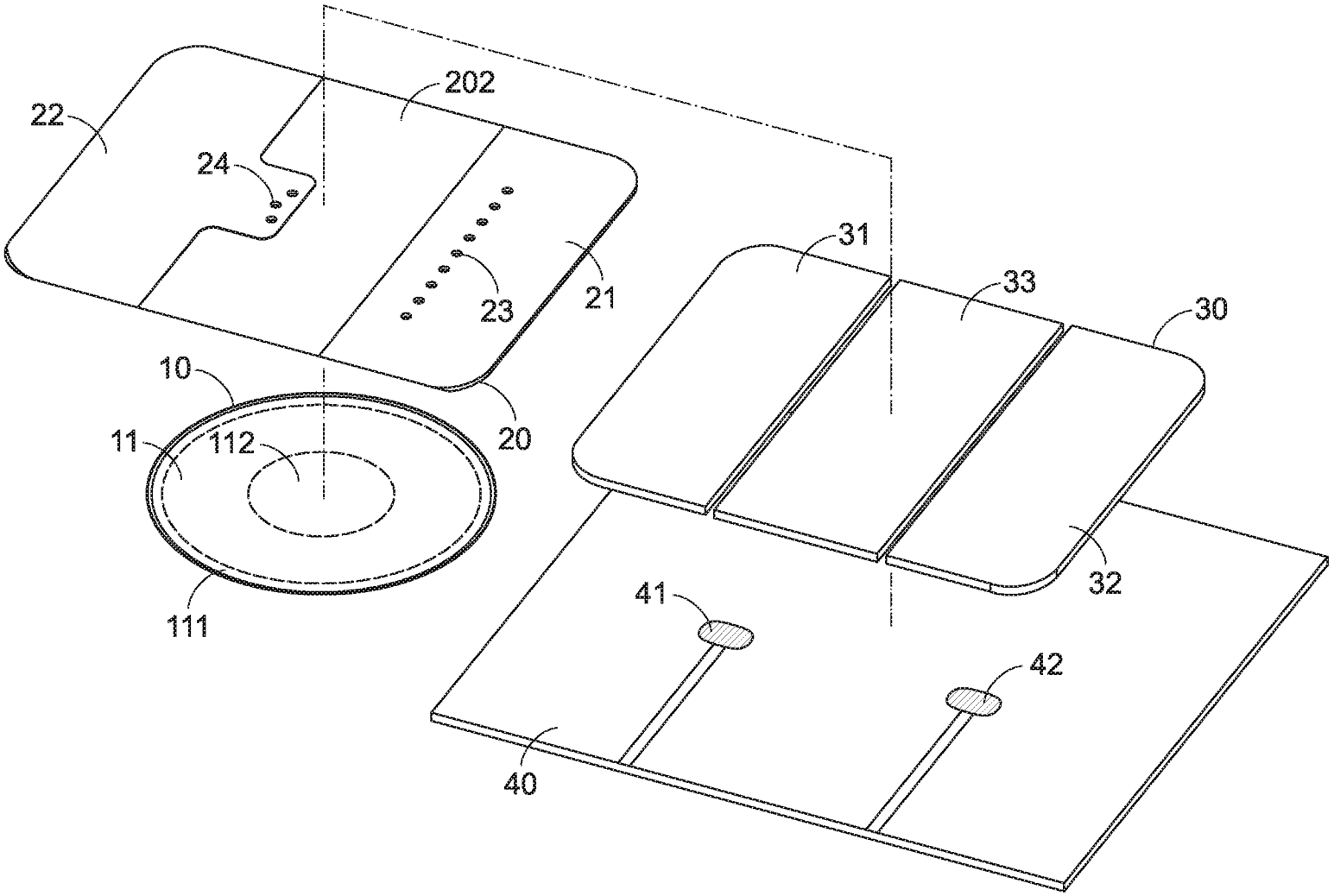
FIG. 4 is a schematic exploded view illustrating the relationship between the dome switch button and the circuit board as shown in FIG. 2 and taken along another viewpoint.

FIG. 2 is a schematic perspective view illustrating the relationship between a dome switch button and a circuit board according to an embodiment of the present invention. FIG. 3 is a schematic exploded view illustrating the relationship between the dome switch button and the circuit board as shown in FIG. 2. FIG. 4 is a schematic exploded view illustrating the relationship between the dome switch button and the circuit board as shown in FIG. 2 and taken along another viewpoint.

The present invention provides a dome switch button 1. The dome switch button 1 is installed on a surface of a circuit board 40. The dome switch button 1 comprises an elastic piece 10, a conductive piece 20 and a buffering element 30.

The elastic piece 10 has a conductive surface 11. The conductive piece 20 comprises a top surface 201, a bottom surface 202, a first conductive part 21 and a second conductive part 22. The circuit board 40 comprises a first electric pad 41 and a second electric pad 42. The conductive surface 11 of the elastic piece 10 is made of conductive material. Consequently, electricity can flow through the conductive surface 11 of the elastic piece 10. The conductive piece 20 is located under the conductive surface 11 of the elastic piece 10. The top surface 201 of the conductive piece 20 is aligned with the conductive surface 11 of the elastic piece 10. The bottom surface 202 of the conductive piece 20 is aligned with the buffering element 30. The first conductive part 21 and the second conductive part 22 are extended from the top surface 201 of the conductive piece 20 to the bottom surface 202 of the conductive piece 20. Consequently, the first conductive part 21 and the second conductive part 22 can be electrically connected with the conductive surface 11 of the elastic piece 10 and the buffering element 30. The buffering element 30 is located under the conductive piece 20 and electrically connected with the first conductive part 21 and the second conductive part 22 of the conductive piece 20. The circuit board 40 is located under the buffering element 30. The first electric pad 41 and the second electric pad 42 of the circuit board 40 are covered by the buffering element 30. In addition, the buffering element 30 is electrically connected with the first electric pad 41 and the second electric pad 42 of the circuit board 40.

The detailed structure of the dome switch button 1 will be illustrated with reference to the exploded views of FIGS. 3 and 4. The conductive surface 11 of the elastic piece 10 comprises a peripheral part 111 and a triggering part 112. The conductive piece 20 comprises at least one first conductive hole 23 and at least one second conductive hole 24. The buffering element 30 comprises a first conducting region 31, a second conducting region 32 and an insulation region 33. The peripheral part 111 of the conductive surface 11 of the elastic piece 10 is electrically connected with the first conductive part 21 of the conductive piece 20. The triggering part 112 of the conductive surface 11 of the elastic piece 10 is aligned with the second conductive part 22 of the conductive piece 20. The at least one first conductive hole 23 and the at least one second conductive hole 24 of the conductive piece 20 are extended from the top surface 201 of the conductive piece 20 to the bottom surface 202 of the conductive piece 20. Consequently, the top surface 201 and the bottom surface 202 are in communication with each other through the at least one first conductive hole 23 and the at least one second conductive hole 24. The at least one first conductive hole 23 is formed in the first conductive part 21 of the conductive piece 20. The at least one second conductive hole 24 is formed in the second conductive part 22 of the conductive piece 20. Consequently, the first conductive part 21 is extended from the top surface 201 to the bottom surface 202 through the at least one first conductive hole 23, and the second conductive part 22 is extended from the top surface 201 to the bottom surface 202 through the at least one second conductive hole 24. The buffering element 30 is installed on the bottom surface 202 of the conductive piece 20 and electrically connected with the circuit board 40. The first conducting region 31 of the buffering element 30 is electrically connected with the first conductive part 21 of the conductive piece 20, and the first electric pad 41 of the circuit board 40 is covered by the first conducting region 31 of the buffering element 30. The second conducting region 32 of the buffering element 30 is electrically connected with the second conductive part 22 of the conductive piece 20, and the second electric pad 42 of the circuit board 40 is covered by the second conducting region 32 of the buffering element 30. The position of the insulation region 33 of the buffering element 30 is aligned with the position of the triggering part 112 of the elastic piece 10. The insulation region 33 is arranged between the first conducting region 31 and the second conducting region 32. Due to the arrangement of the insulation region 33, the first conducting region 31 and the second conducting region 32 are not contacted with each other.

Figure 5:
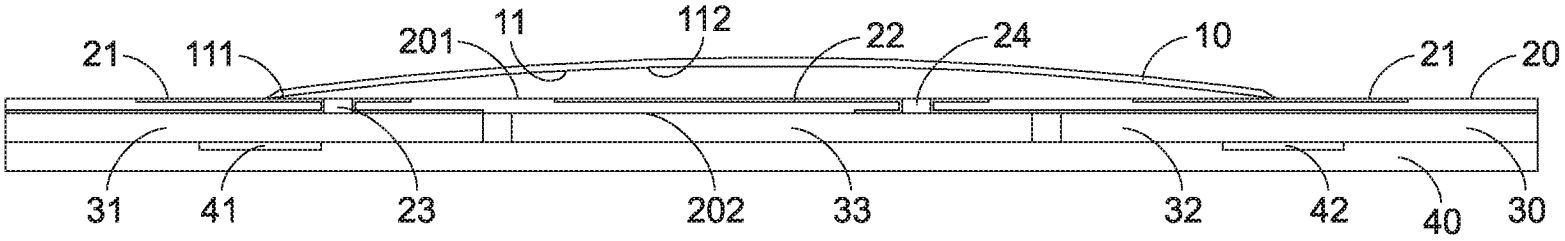
FIG. 5 is a schematic cross-sectional view illustrating the dome switch button in an undepressed state.
Figure 6:
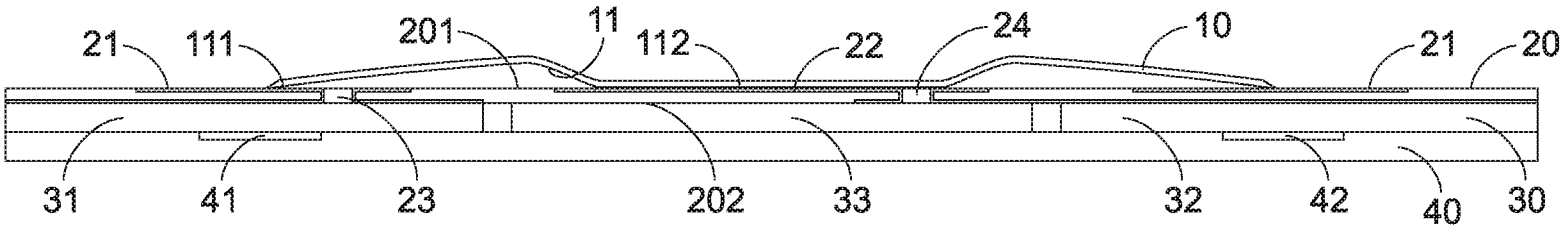
FIG. 6 is a schematic cross-sectional view illustrating the dome switch button in a depressed state.

The triggering conduction of the dome switch button 1 will be described as follows. FIG. 5 is a schematic cross-sectional view illustrating the dome switch button in an undepressed state. FIG. 6 is a schematic cross-sectional view illustrating the dome switch button in a depressed state.

Please refer to FIG. 5. When the dome switch button 1 is not depressed (i.e., in an undepressed state), the electricity (not shown) from the circuit board 40 is transferred to the first conducting region 31 of the buffering element 30 through the first electric pad 41. Since the first conducting region 31 of the buffering element 30 and the first conductive part 21 of the conductive piece 20 are electrically connected with each other, the electricity (not shown) is transferred from the bottom surface 202 of the conductive piece 20 to the top surface 201 of the conductive piece 20 through the at least one first conductive hole 23 via the conduction of the first conductive part 21. After the electricity (not shown) is transferred to the top surface 201, the electricity is transferred to the elastic piece 10 through the peripheral part 111 of the conductive surface 11. Under this circumstance, the electricity (not shown) is not transferred back to the circuit board 40. Since the circuitry of the circuit board 40 is not electrically conducted, no electric signal is generated.

Please refer to FIG. 6. When the dome switch button 1 is depressed and triggered, the elastic piece 10 is subjected to elastic deformation in the direction toward the conductive piece 20. Consequently, the triggering part 112 of the conductive surface 11 is contacted with the second conductive part 22 of the conductive piece 20. After the electricity (not shown) is transferred to the elastic piece 10, the electricity is transferred from the top surface 201 of the conductive piece 20 to the bottom surface 202 of the conductive piece 20 through the at least one second conductive hole 24 via the conduction of the second conductive part 22. After the electricity (not shown) is transferred to the bottom surface 202 of the conductive piece 20, the electricity is transferred to the second electric pad 42 of the circuit board 40 through the second conducting region 32 of the buffering element 30. Consequently, the electricity (not shown) is transferred back to the circuit board 40. Since the elastic piece 10 is triggered, the electricity (not shown) from the first electric pad 41 of the circuit board 40 can be transferred back to the second electric pad 42 of the circuit board 40 through the conductive piece 20 and the buffering element 30. Consequently, the circuitry of the circuit board 40 is electrically conducted, and an electric signal is generated.

When the dome switch button 1 is depressed and triggered, the triggering part 112 of the conductive surface 11 of the elastic piece 10 is moved downwardly to collide with the conductive piece 20. Meanwhile, the insulation region 33 of the buffering element 30 can alleviate the impact force of the triggering part 112 and protect the conductive piece 20 and the circuit board 40 while maintaining the tactile feel. Since the insulation region 33 is arranged between the first conducting region 31 and the second conducting region 32, the first conducting region 31 and the second conducting region 32 are not contacted with each other and the short-circuited condition is avoided.

The first conductive part 21 and the second conductive part 22 of the conductive piece 20 are made of conductive material or metallic material. The conductive material or the metallic material is coated, electroplated or adhered on the conductive piece 20. Alternatively, the conductive material or the metallic material is installed on the conductive piece 20 by using a metal bending process. Moreover, the first conducting region 31 and the second conducting region 32 of the buffering element 30 directly cover the first electric pad 41 and the second electric pad 42 of the circuit board 40, respectively, in an adhering manner or an electroplating manner.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A dome switch button installed on a circuit board, the dome switch button comprising:

an elastic piece with a conductive surface;

a conductive piece located under the conductive surface of the elastic piece, wherein the conductive piece comprises a first conductive part and a second conductive part; and a buffering element located under the conductive piece and electrically connected with the first conductive part and the second conductive part of the conductive piece, wherein the circuit board comprises a first electric pad and a second electric pad, wherein the first electric pad and the second electric pad of the circuit board are covered by the buffering element, and the buffering element is electrically connected with the first electric pad and the second electric pad of the circuit board, wherein the conductive piece has a top surface and a bottom surface, wherein the top surface of the conductive piece is aligned with the conductive surface of the elastic piece, and the bottom surface of the conductive piece is aligned with the buffering element, wherein the conductive piece further comprises at least one first conductive hole and at least one second conductive hole, wherein the at least one first conductive hole and the at least one second conductive hole are in communication with the top surface and the bottom surface of the conductive piece.

2. The dome switch button according to claim 1, wherein the conductive surface of the elastic piece comprises a peripheral part and a triggering part, wherein the peripheral part is electrically connected with the first conductive part of the conductive piece, and the triggering part is aligned with the second conductive part of the conductive piece.

3. The dome switch button according to claim 1, wherein the first conductive part of the conductive piece is extended from the top surface to the bottom surface, so that the first conductive part of the conductive piece is electrically connected with the conductive surface of the elastic piece and the buffering element, wherein the second conductive part of the conductive piece is extended from the top surface to the bottom surface, so that the second conductive part of the conductive piece is aligned with the conductive surface of the elastic piece and electrically connected with the buffering element.

4. The dome switch button according to claim 1, wherein the at least one first conductive hole is formed in the first conductive part of the conductive piece, so that the first conductive part is extended from the top surface to the bottom surface through the at least one first conductive hole, wherein the at least one second conductive hole is formed in the second conductive part of the conductive piece, so that the second conductive part is extended from the top surface to the bottom surface through the at least one second conductive hole.

5. The dome switch button according to claim 1, wherein the buffering element comprises a first conducting region, a second conducting region and an insulation region, wherein the insulation region is arranged between the first conducting region and the second conducting region, so that the first conducting region and the second conducting region are not contacted with each other.

6. The dome switch button according to claim 5, wherein the first conducting region of the buffering element is electrically connected with the first conductive part of the conductive piece and the first electric pad of the circuit board, and the second conducting region of the buffering element is electrically connected with the second conductive part of the conductive piece and the second electric pad of the circuit board.

7. The dome switch button according to claim 5, wherein the first electric pad of the circuit board is covered by the first conducting region of the buffering element, and the second electric pad of the circuit board is covered by the second conducting region of the buffering element.

* * * * *